United States Patent [19]

Moss

[11] 4,170,078

[45] Oct. 9, 1979

[54] CUSHIONED FOOT SOLE

[76] Inventor: Ronald Moss, 211 Stagg Walk, Brooklyn, N.Y. 11206

[21] Appl. No.: 891,504

[22] Filed: Mar. 30, 1978

[51] Int. Cl.[2] ..... A43B 13/18; A43B 13/20

[52] U.S. Cl. ..... 36/28; 36/29; 36/44

[58] Field of Search ..... 36/28, 29, 3 R, 3 B, 36/35 R, 35 B, 43, 44

[56] References Cited

U.S. PATENT DOCUMENTS

| | | | |
|---|---|---|---|
| 1,598,809 | 9/1926 | Dressel | 36/28 |
| 1,639,381 | 8/1927 | Manelas | 36/29 |
| 2,404,083 | 7/1946 | Murray | 36/28 X |
| 3,087,262 | 4/1963 | Russell | 36/28 |
| 3,608,215 | 9/1971 | Fukuoka | 36/29 |
| 3,724,106 | 4/1973 | Magidson | 36/44 |
| 4,008,530 | 2/1977 | Gager | 36/28 |

*Primary Examiner*—James Kee Chi

[57] ABSTRACT

A cushioned sole for the foot which is hollow and resilient the interior having contained a fluid or other flowable material, such as sand and the like, the sole having for a principal purpose the affording of maximum comfort for the wearer. Small air valves are provided to allow the sole to breathe the degree of which is subject to control by slide covers. The sole is composed of discrete parts each specially shaped to prevent back sliding of the foot when walking on loose sand or climbing dirt trails. A second, flattened sole may be attached to the first sole for more ordinary usage of the subject foot wear.

5 Claims, 5 Drawing Figures

CUSHIONED FOOT SOLE

The invention relates to foot wear and, in particular, to shoes, sandles and the like having cushioned soles for foot wear containing pockets for flowable material such as air, felt or cork.

Air cushioned soles for the underside of shoes with valves for adjusting pressure are known in the art. See, for example, U.S. Pat. No. 2,620,574 and more recently issued U.S. Pat. No. 3,120,712. The present cushioned sole contains hollowed segment valves of a unique character in this art. Each segment is designed to afford obliquely oriented trailing edges to give maximum grip on soft ground such as beaches, gravel and the like. It has been found that when the segments are filled with sand as well as air a high degree of comfort is afforded the wearer. The segments bottom surfaces are of sufficient area to permit a second sole to be attached as a lamination, if desired, for ordinary street wear.

One object of the invention is to provide a foot sole of unique construction which affords air cushioned comfort to the wearer as well as maximum grippage to soft surfaces in contact therewith.

Other objects and advantages of the invention may be appreciated on reading the following description of several embodiments thereof which are taken in conjunction with the accompanying drawings, in which.

Figure 1:
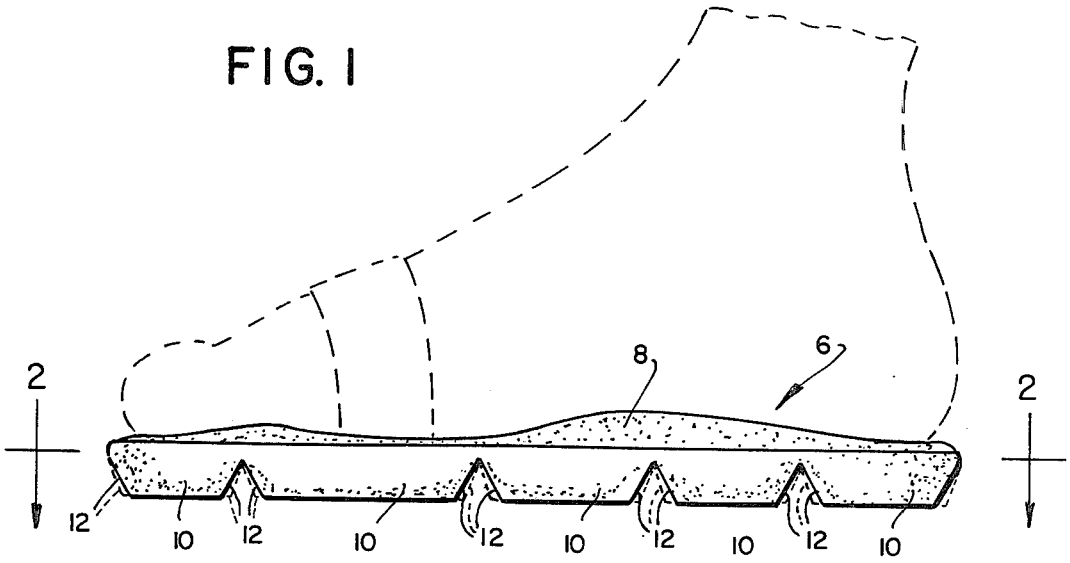
FIG. 1 is a side elevation of the cushioned foot wear with the individual segments shown deflected in dotted line.

Referring to the drawings foot sole 6 comprises top layer foam insert 8 from which depends a plurality of segments 10. Each segment is trapezoidal in shape on a longitudinal cross section having oblique leading and trailing edges 12. When pressure is applied by the foot in the course of walking on lose gravel or sand, for example, the segments are caused to deflect slightly as shown by their dotted line positions of the edges in FIG. 1.

Figure 2:
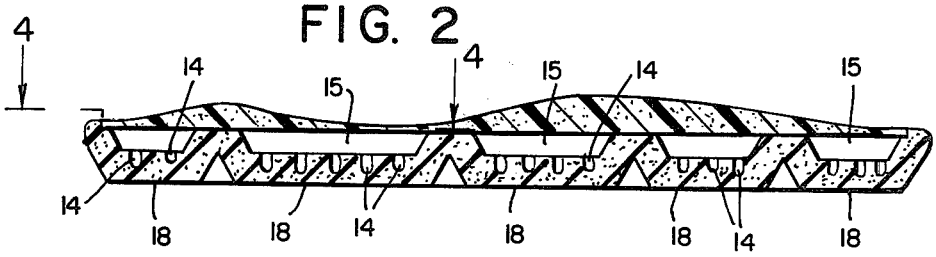
FIG. 2 is a section taken on the line 2—2 of FIG. 1 showing the segments and air pockets therein.
Figure 3:
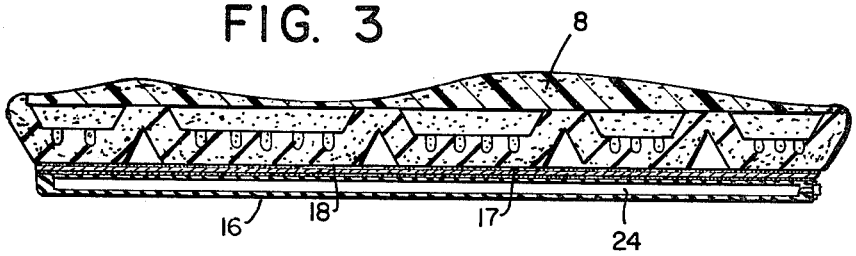
FIG. 3 shows a modification in section of the invention showing the pockets sand filled, and a second bottom sole.
Figure 4:
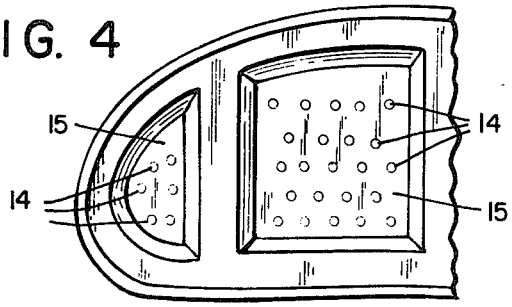
FIG. 4 is a section on line 4—4 of FIG. 2 with the foam insert omitted.
Figure 5:
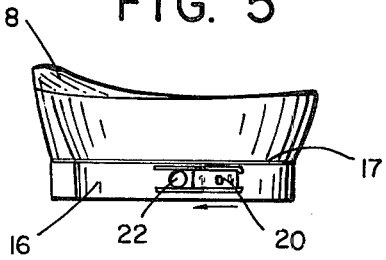
FIG. 5 is an end view of the foot wear shown in FIG. 3 showing the air escape port and adjustable valve structure for the bottom sole.

The segments 10 are preferably fabricated of a high density foam having air pockets 14 communicating with a hollow center 15 as shown in FIG. 2. If desired, the hollow center may be sand filled as shown in FIG. 3.

For ordinary street walking a second sole 16 may be attached as by dual backed adhesive tape 17 to the bottom surfaces 18 of the segments. The sole 16 is actually an air chamber having an end slide valve 20 to control the rate of air escape through air port 22. Air enters the sole 16 through side holes 24. In the process of deflating the sole 16 as the weight of the wearer is exerted on it while walking, air is expressed out of its chamber and through the port 22 at a velocity depending on the position of the slide valve 20 relative to the port 22. When the chamber inflates as the weight is removed therefrom air is drawn in through the holes 24 to provide the desired air cushion in support of wearer in taking his next step.

Various other modifications of the invention may be effected by persons skilled in the art without departing from the scope and principle thereof as defined in the appended claims.

What is claimed is:

1. A cushioned foot sole comprising a top layer, a plurality of trapezoidal shaped segments depending at terminal and intermediate points therefrom, said segments having a hollow central portion and air pockets communicating therewith and formed therein.

2. A cushioned foot sole as defined in claim 1 wherein said hollow portions of the segments are at least partially sand filled.

3. A foot sole as defined in claim 1 wherein a second sole formed as an apertured air chamber is secured underneath said segments.

4. A foot sole as defined in claim 2 wherein a second sole formed as an apertured air chamber is secured underneath said segments.

5. A foot sole as defined in claim 3 wherein an escape air port is provided for said chamber having a slide valve control therefor.

* * * * *